United States Patent [19]

Won

[11] Patent Number: 5,004,256

[45] Date of Patent: Apr. 2, 1991

[54] SOUND AND/OR LIGHT GENERATING DEVICE FOR SKATEBOARDS

[76] Inventor: John Won, P.O. Box 10780, Taipei, Taiwan

[21] Appl. No.: 463,213

[22] Filed: Jan. 10, 1990

[51] Int. Cl.[5] ..... B62M 1/00

[52] U.S. Cl. ..... 280/87.042; 362/78

[58] Field of Search ..... 280/87.042, 87.041; 362/78; 455/345, 346; 180/181

[56] References Cited

U.S. PATENT DOCUMENTS 4,027,890 6/1977 Volkmann ..... 280/87.042

4,824,139 4/1989 Robbins ..... 280/87.042

*Primary Examiner*—Andre Kashnikow

*Assistant Examiner*—Rich Camby

*Attorney, Agent, or Firm*—Pollock, Vande Sande & Priddy

[57] ABSTRACT

A combination of a skateboard and electronic device for generating sound and/or light. The electronic device is affixed under the skateboard and a switch means is provided that can be operated by stepping on an operating element thereof.

18 Claims, 3 Drawing Sheets

SOUND AND/OR LIGHT GENERATING DEVICE FOR SKATEBOARDS

FIELD OF THE INVENTION

The present invention relates to a device which can generate sound and/or light for the skateboard from an electronic box affixed under the skateboard as the pedal, which is disposed within the footstep area on the skateboard, being stepped.

BACKGROUND OF THE INVENTION

A conventional skateboard is generally composed of a board with four wheels attached underneath for the player to step on and move forward. Skateboard-playing is very popular in view of the speed-enjoyment and balance training it provides. There are now various skateboards on the market and one of which is provided with a radio under the skateboard with an antenna attached onto the bottom of the board to form a skateboard with sounds. Such skateboard delivers sounds constantly while being played and it is usually the music from the radio station which may not be preferably desired. It is therefore considered that a skateboard with a sound and/or light generating device which the player can control the sounding or lighting period as well as vary the sound and light will be much more desirable.

SUMMARY OF THE INVENTION

It is the object of the present invention to provide a sound and/or light generating electronic device to be affixed onto the skateboard with at least one hole, a pedal of the switch means of the device is disposed on the footstep area of the skateboard for the player to step on and cause thereby sounds and/or light. It's a further object of the present invention to provide a skateboard that, disposed with sound and/or light generating device of which the switch is foot-controlled, is more interesting and as being used, function as a warning-horn-equipped skateboard to call people's attention.

To achieve the aforegoing objectives, it's provided an electronic box comprising a battery, a sound and/or light generating device and switch means. A flange with a central hole is offered on the body of the box. A post of the switch means is disposed to stretch from inside of the box through the central hole of the flange up to the top of the box to be connected with a pedal which is held constantly at its upmost first position by a spring element disposed in the box; as the pedal is stepped on descend, the switch means will be "on" to transmit electricity whereby the sound and/or light generating device can function to produce sound or light. On the skateboard, there's provided at least one hole to receive from beneath the flange of the electronic box for affixing the box onto the board thereby, and also to receive the post for attaching with the pedal installed within the footstep area on the surface of the board.

A preferred embodiment is set forth in the following description in connection with the accompanying drawings to be realized that the present invention is a successfully practicable design, and it is not expected to limit the scope of claims by the illustrated embodiment.

DETAILED DESCRIPTION OF THE INVENTION

Figure 1:
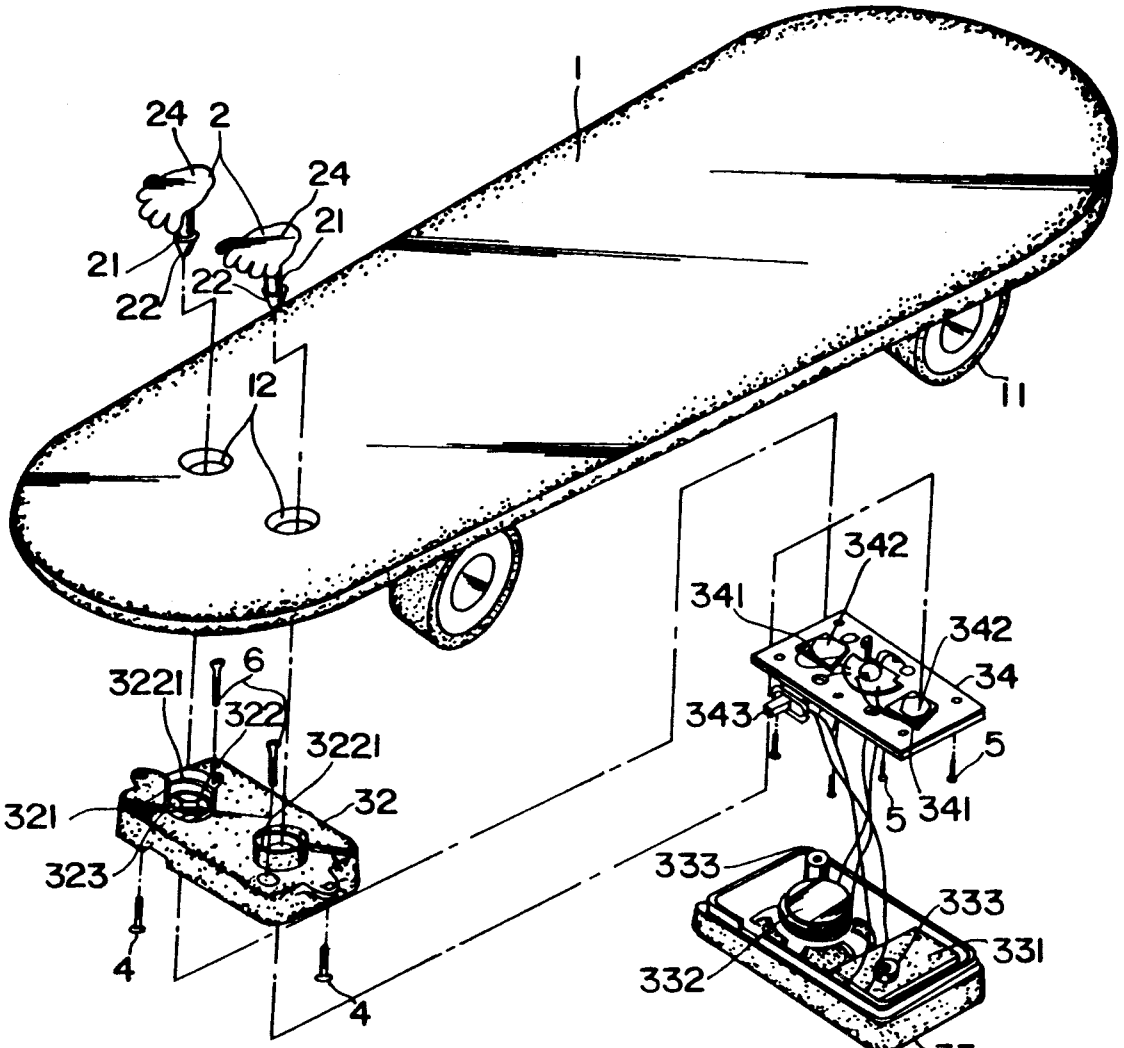
FIG. 1 is a perspective exploded view of the preferred embodiment of the present invention.
Figure 2:
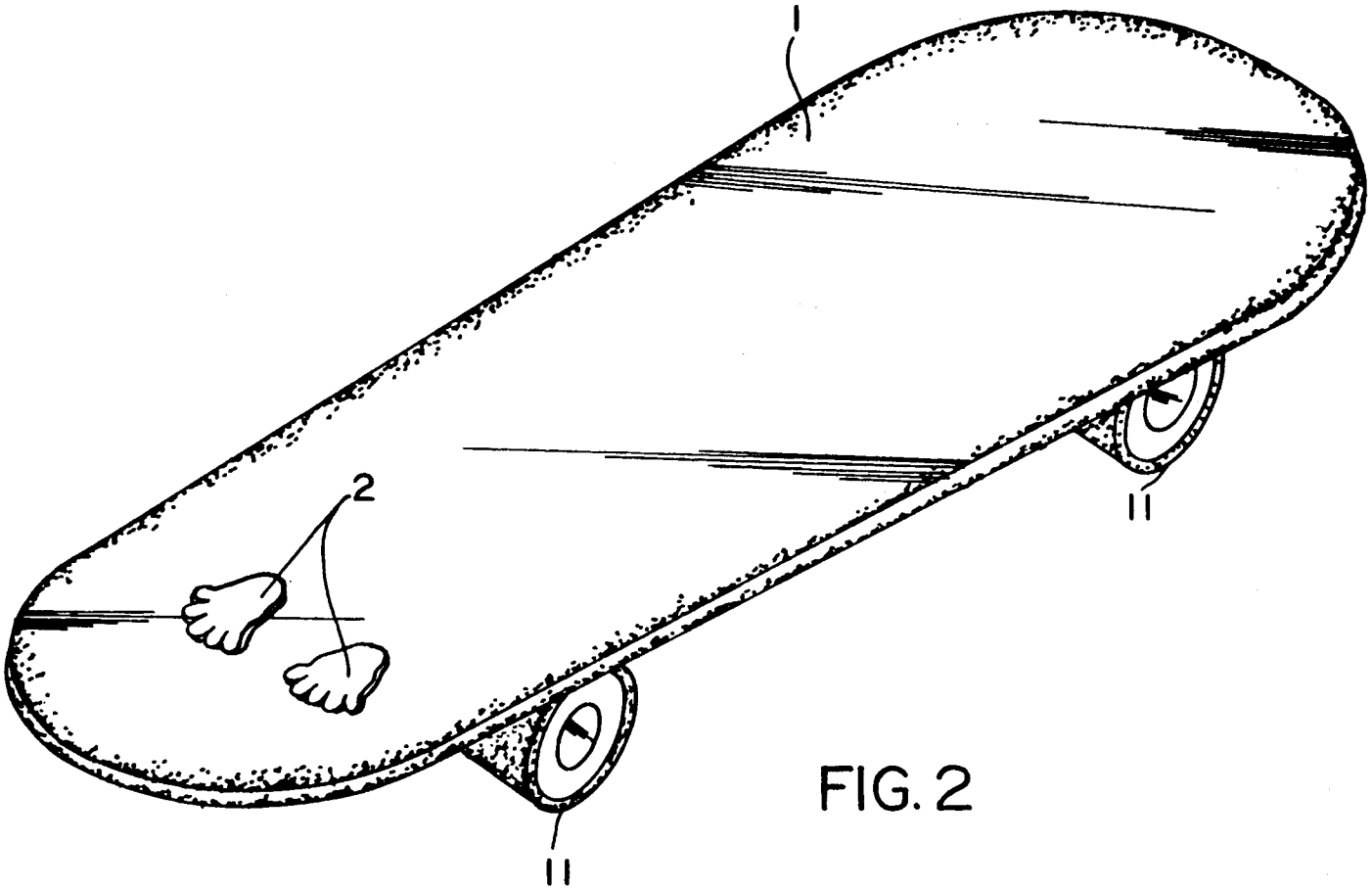
FIG. 2 is a perspective view of the preferred embodiment of the present invention.

Referring now to FIGS. 1, 2, 3 and 4, the skateboard of the present invention is provided with rollers 11 from beneath for skating, one hole 12 at least formed within the area on the board available for stepping on and an electronic box 3 affixed from beneath with screws 4. The body of the electronic box 3 comprises the upper shell 32, the lower shell 33 and the circuit board 34. A flange 321 is formed on the top of the upper shell 32 with a size which fits properly in the hole 12 of the skateboard and a height equals generally to the thickness of the skateboard, preferably around 5 mm–25 mm; the flange 321 has further a central hole 322 which is narrowed at the middle of the height to form a shoulder 323. On the circuit board 34, a touch-off means 341 comprising a spring element 342 is provided right beneath the hole 322 of the flange 321, and a hand-operating second switch means 343 is also provided thereon stretching out of the electronic box from the side.

Referring now to the lower shell 33 of the box, there is provided a battery chamber 331 receiving the battery to supply electricity to the device as well as a speaker 332. Furthermore, the pedal 2 of the touch-off means 341 is formed at its top an enlarged flat surface 24 with a post 21 thereunder and at its lower end an enlarged conical end 22 for sticking easely into the shoulder 323 of the flange hole 322 whereby the conical end will be held by the bottom edge of the shoulder 323 in the hole 322 to keep the pedal 2 from coming off the box 3. The post 21 of the pedal is available to move up and down freely in the hole 322, however, it is kept constantly at its upmost position by the spring element 342.

The circuit board 34 is firstly mounted into the upper shell 32 by screws 5 and then this combined set is mounted onto the lower shell 33 by screws 6 driving into the studs 333 and 325 in the lower shell. As the flat surface 24 of the pedal is stepped to descend, the conical end 22 at the lower end of the post 21 will descend along with the post and press the spring element 342 to set on the touch-off means 341 and electrify the IC on the circuit board, whereby the speaker 332 in the lower shell is sounding or the bulbs 334 disposed on the surface or the side of the skateboard are lighting consequently to achieve the sound and light effect for the skateboard; when the stepping pressure is removed, the spring element 342 will return to its original position and cut off the circuit as getting ready for next touch.

Figure 5:
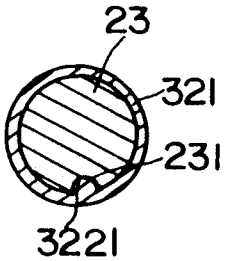
FIG. 5 is a cross-sectional view taken along line 5—5 of FIG. 4.
Figure 3:
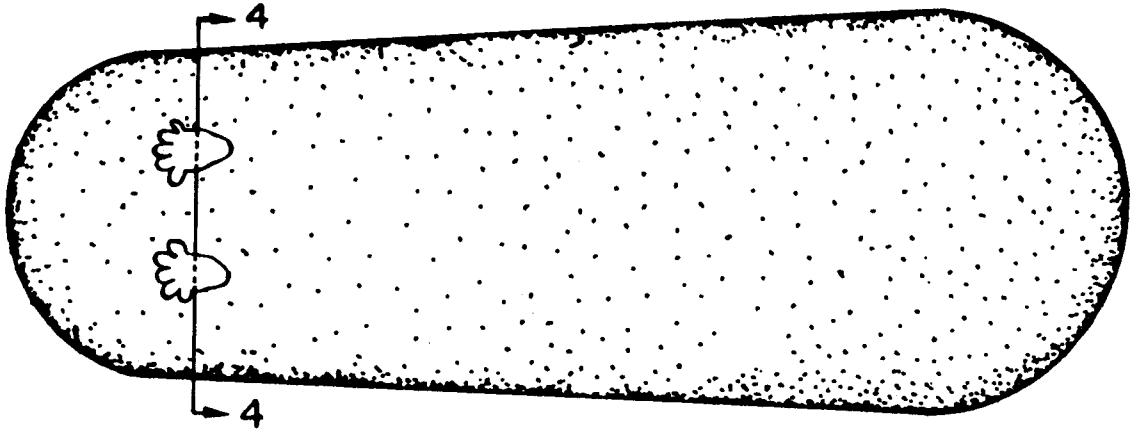
FIG. 3 is a top view of the preferred embodiment of the present invention.
Figure 4:
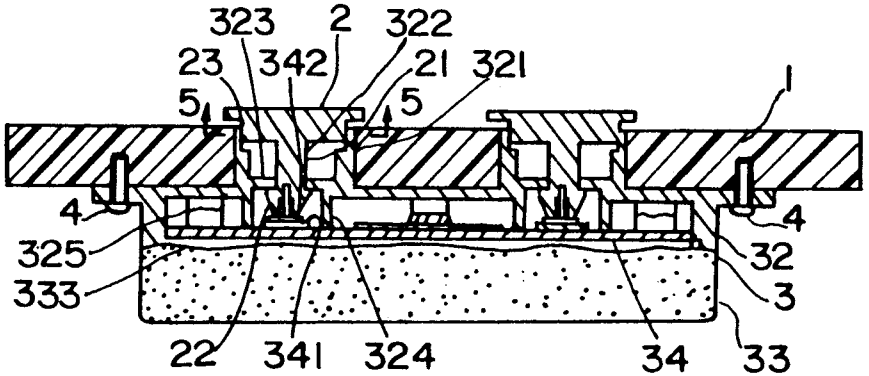
FIG. 4 is a cross-sectional view taken along line 4—4 of FIG. 3.

To assure the pedal to be forced downwards smoothly without unefficient rotation, a U-shaped slot 231, as shown in FIG. 5, is formed at the base 23 of the flat surface of the pedal for a convex strip 3221, formed at the upper part in the flange hole, to fit in so that the pedal will not be able to rotate. As the stepping pressure is brought to the pedal, the conical end 22 will accordingly be forced downwards directly and touch off the electricity smoothly.

Moreover, variety of the circuitry can be made in the present invention to bring in various functions, e.g.

touch-off phonic system, music IC or light glittering control circuit; more pedals can be added to the device as needed; and the hand-operating 2nd switch means 343 on the circuit board of the present invention can be formed as a multi-selection switch available for selecting different effects according to different preference.

I claim:

1. A combination of a skateboard and sound generating device for said skateboard which comprises:

said skateboard containing at least one hole in the board;

an electronic box affixed onto said hole of said skateboard from the bottom, and comprising an electricity means disposed therein;

a sound generating means; and a first switch means controlling said electricity means to supply electricity to said sound generating means;

said first switch means comprising an operating element disposed on the upper shell of said box and extending through said hole of said skateboard located in the footstep area on said skateboard; whereby stepping on said operating element of said first switch means results in the transmission of electricity from the electricity means in the electronic box to said sound generating means to thereby generate sound.

2. A combination according to claim 1, wherein said electricity means of the electronic box further comprises a hand-operating switch means, disposed on said box, which can be operated by hand to disconnect electricity, in off condition, to said sound generating device, even if the first switch means is on.

3. A combination according to claim 1, wherein two holes are provided in said skateboard.

4. A combination according to claim 1, wherein the upper shell of said electronic box is provided with a hollow flange to be received into the hole of said skateboard.

5. A combination according to claim 1, wherein said operating element of the first switch means comprises:

a pedal being disposed within the footstep area of said skateboard;

a post being affixed beneath said pedal which can move up and down freely through the hole on said skateboard and the hollow flange on said electronic box; an enlarged conical end at the lower end of said post holds said post to a fixed element located in said hole on the skateboard as it moves to the upmost position, so that the post will not come off said skateboard easily;

a spring element disposed for pushing up said post to its upmost position while the descending pressure of the post made by stepping has been released; and a touch-off means being affixed below said post to start electrifying as the post descends from its upmost position.

6. A combination according to claim 4 wherein the height of said flange provided on said upper shell of the electronic box is available between 5 mm–25 mm.

7. A skateboard and electronic box combination which comprises:

a body having an upper shell provided with a flange, wherein said flange is hollow with a hole inside;

a battery being attached in said body;

a sound generating means, electrified by said battery for generating sound;

a switch means disposed for controlling the transmission of the electricity from the battery to said sound generating means; said switch means comprises a post which is able to move up and down freely, wherein the upper end of said post extends out of said body through said hole provided in the flange on the body;

a spring element that maintains said post constantly at a first position to disconnect the electricity; and a pedal, affixed to the upper end of said post;

said body is attached to said skateboard, which has two holes therein from the bottom by receiving the flange of the body into said holes in said skateboard; and said pedal, affixed at the upper end of said post being extended through said hole, is kept within the footstep area on the skateboard.

8. A combination according to claim 7, wherein the height of said flange on the body is available between 5 mm and 25 mm.

9. The combination of claim 1 wherein said sound generating means is also a light generating means.

10. The combination of claim 7 wherein said sound generating means is also a light generating means.

11. A combination of a skateboard and light generating device for said skateboard which comprises:

said skateboard containing at least one hole in the board;

an electronic box affixed onto said hole of said skateboard from the bottom, and comprising an electricity means disposed therein;

a light generating means; and a first switch means controlling said electricity means to supply electricity to said light generating means;

said first switch means comprising an operating element disposed on the upper shell of said box and extending through said hole of said skateboard located in the footstep area on said skateboard; whereby stepping on said operating element of said first switch means results in the transmission of electricity from the electricity means in the electronic box to said light generating means to thereby generate light.

12. A combination according to claim 1, wherein said electricity means of the electronic box further comprises a hand-operating switch means, disposed on said box, which can be operated by hand to disconnect electricity, in off condition, to said light generating device, even if the first switch means is on.

13. A combination according to claim 11, wherein two holes are provided in said skateboard.

14. A combination according to claim 11, wherein the upper shell of said electronic box is provided with a hollow flange to be received into the hole of said skateboard.

15. A combination according to claim 11, wherein said operating element of the first switch means comprises:

a pedal being disposed within the footstep area of said skateboard;

a post being affixed beneath said pedal which can move up and down freely through the hole on said skateboard and the hollow flange on said electronic box; and enlarged conical end at the lower end of said post holds said post to a fixed element located in said hole on the skateboard as it moves to the upmost position, so that the post will not come off said skateboard easily;

a spring element disposed for pushing up said post to its upmost position while the descending pressure of the post made by stepping has been released; and a touch-off means being affixed below said post to start electrifying as the post descends from its upmost position.

16. A combination according to claim 4 wherein the height of said flange provided on said upper shell of the electronic box is available between 5 mm–25 mm.

17. A skateboard and electronic box combination which comprises:

a body having an upper shell provided with a flange, wherein said flange is hollow with a hole inside;

a battery being attached in said body;

a light generating means, electrified by said battery for generating light;

a switch means disposed for controlling the transmission of the electricity from the battery to said light generating means; said switch means comprises a post which is able to move up and down freely, wherein the upper end of said post extends out of said body through said hole provided in the flange on the body;

a spring element that maintains said post constantly at a first position to disconnect the electricity; and a pedal, affixed to the upper end of said post;

said body is attached to said skateboard which has two holes therein, from the bottom by receiving the flange of the body into said holes in said skateboard; and said pedal, affixed at the upper end of said post being extended through said hole, is kept within the footstep area on the skateboard.

18. A combination according to claim 7, wherein the height of said flange on the body is available between 5 mm and 25 mm.

* * * * *